US010878762B2

(12) United States Patent
Shi et al.

(10) Patent No.: US 10,878,762 B2
(45) Date of Patent: Dec. 29, 2020

(54) LUMINANCE COMPENSATING METHOD, LUMINANCE COMPENSATING DEVICE, DISPLAY DEVICE AND STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Tiankuo Shi, Beijing (CN); Lingyun Shi, Beijing (CN); Yifang Chu, Beijing (CN); Yilang Sun, Beijing (CN); Zhihua Ji, Beijing (CN); Yue Li, Beijing (CN); Chuanjun Liu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/398,709

(22) Filed: Apr. 30, 2019

(65) Prior Publication Data

US 2019/0348001 A1 Nov. 14, 2019

(30) Foreign Application Priority Data

May 8, 2018 (CN) ..... 2018 1 0433361

(51) Int. Cl.
*G09G 3/34* (2006.01)
*G09G 3/32* (2016.01)

(52) U.S. Cl.
CPC ..... *G09G 3/3426* (2013.01); *G09G 3/32* (2013.01); *G09G 2320/064* (2013.01); *G09G 2360/16* (2013.01)

(58) Field of Classification Search
CPC .... G09G 3/3426; G09G 3/32; G09G 2360/16; G09G 2320/064; G09G 2320/0626; G09G 2320/0693
See application file for complete search history.

(56) References Cited

U.S. PATENT DOCUMENTS 10,176,770 B2 1/2019 Zhang
2005/0212736 A1* 9/2005 Lu ..... G09G 3/3611 345/87

(Continued)

FOREIGN PATENT DOCUMENTS

CN 1916721 A 2/2007
CN 101425275 A 5/2009

(Continued)

OTHER PUBLICATIONS

First Chinese Office Action dated Jul. 2, 2019.

(Continued)

*Primary Examiner* — Mark W Regn
(74) *Attorney, Agent, or Firm* — Dilworth & Barrese, LLP.; Michael J. Musella, Esq.

(57) ABSTRACT

A luminance compensating method of a display device, a luminance compensating device, a display device and a storage medium. The display device includes a backlight module and a display panel, the display panel includes a plurality of portions, the backlight module includes a plurality of backlight units, and the plurality of backlight units respectively correspond to the plurality of portions. The method includes: setting luminance values of the plurality of backlight units of the backlight module to an identical set luminance value, and setting gray level data of a plurality of pixel units of the display panel to an identical set gray level value; measuring light-emitting luminance values of the plurality of portions of the display panel to obtain a first luminance matrix of the display panel, in a case where the (Continued)

plurality of backlight units emit light; determining a compensation-coefficient matrix based on the first luminance matrix.

17 Claims, 6 Drawing Sheets

(56) References Cited

U.S. PATENT DOCUMENTS

| | | | | |
|---|---|---|---|---|
| 2009/0109165 | A1* | 4/2009 | Park | G09G 3/3426 345/102 |
| 2013/0155085 | A1 | 6/2013 | Fergason | |
| 2015/0117775 | A1* | 4/2015 | Abe | G06T 5/20 382/167 |
| 2015/0339984 | A1 | 11/2015 | Hyun | |
| 2017/0249890 | A1* | 8/2017 | Yoo | G09G 3/2074 |

FOREIGN PATENT DOCUMENTS

| | | | |
|---|---|---|---|
| CN | 101727846 | A | 6/2010 |
| CN | 102298908 | A | 12/2011 |
| CN | 104848094 | A | 8/2015 |
| CN | 106409240 | A | 2/2017 |
| CN | 107749288 | A | 3/2018 |
| EP | 2154673 | A2 | 2/2010 |

OTHER PUBLICATIONS

Li et al, "Two approaches to derive LED driving signals for high-dynamic-range LCD", Journal of the SID, Dec. 15, 2007, pp. 989-996, Rochester, NY.

Zeiler et al. "Deconvolutional Networks", Journal, (http://www.cs.nyu.edu/~zeiler/pubs/cvpr2010/) New York City 2010.

* cited by examiner

| | | | | | | |
|---|---|---|---|---|---|---|
| A1 | A2 | A3 | A4 | A5 | A6 | A7 |
| B1 | B2 | B3 | B4 | B5 | B6 | B7 |
| C1 | C2 | C3 | C4 | C5 | C6 | C7 |
| D1 | D2 | D3 | D4 | D5 | D6 | D7 |
| E1 | E2 | E3 | E4 | E5 | E6 | E7 |
| F1 | F2 | F3 | F4 | F5 | F6 | F7 |
| G1 | G2 | G3 | G4 | G5 | G6 | G7 |

| | | |
|---|---|---|
| K3 | K1 | K3 |
| K2 | K0 | K2 |
| K3 | K1 | K3 |
FIG. 5
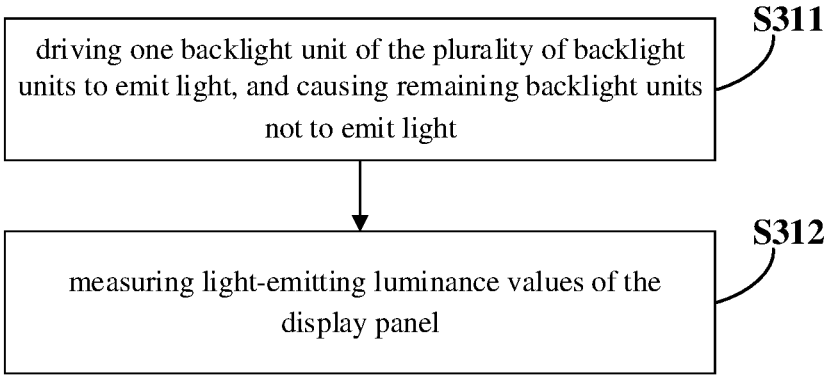
FIG. 6
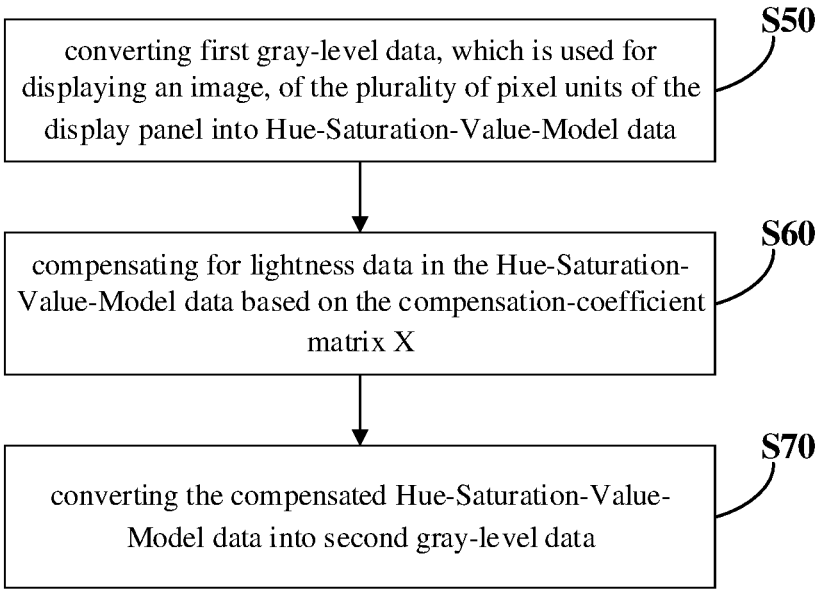
FIG. 7

LUMINANCE COMPENSATING METHOD, LUMINANCE COMPENSATING DEVICE, DISPLAY DEVICE AND STORAGE MEDIUM

The application claims priority to Chinese Patent Application No. 201810433361.3, filed on May 8, 2018, titled "Luminance Compensating Method, Luminance Compensating Device, Display Device and Storage Medium," the entire disclosure of which is incorporated herein by reference as part of the present application.

TECHNICAL FIELD

Embodiments of the present disclosure relate to a luminance compensating method, a luminance compensating device, a display device and a storage medium.

BACKGROUND

The dimension of A micro-light emitting diode (micro-LED) may be reduced to 1% of the dimension of a light-emitting diode (LED), such as 100 micrometers (μm) or less, and the micro-LED has characteristics such as higher light-emitting luminance, higher luminous efficiency, and lower running power consumption, thereby gradually attracting people's attention.

SUMMARY

At least one embodiment of the present disclosure provides a luminance compensating method of a display device. The display device comprises a backlight module and a display panel, the display panel comprises a plurality of portions, the backlight module comprises a plurality of backlight units, and the plurality of backlight units respectively correspond to the plurality of portions. The luminance compensating method comprises: setting luminance values of the plurality of backlight units of the backlight module to an identical set luminance value, and setting gray level data of a plurality of pixel units of the display panel to an identical set gray level value; measuring light-emitting luminance values of the plurality of portions of the display panel to obtain a first luminance matrix of the display panel, upon the plurality of backlight units emitting light; determining a compensation-coefficient matrix based on the first luminance matrix; and compensating for luminance of the display device based on the compensation-coefficient matrix.

For example, in the luminance compensating method provided by at least one embodiment of the present disclosure, the determining the compensation-coefficient matrix based on the first luminance matrix comprises: obtaining a diffusion matrix of the plurality of backlight units; obtaining a first setting matrix of the plurality of backlight units according to a first formula $L1=K\otimes F1$; adjusting at least one value in the first setting matrix to obtain a second setting matrix until an error value of uniformity of a second luminance matrix is smaller than a preset error value, where the second luminance matrix satisfies a second formula $L2=K\otimes F2$; and determining the compensation-coefficient matrix according to a third formula $F2=F1\cdot X$. L1 indicates the first luminance matrix, L2 indicates the second luminance matrix, K indicates the diffusion matrix, F1 indicates the first setting matrix, F2 indicates the second setting matrix, X indicates the compensation-coefficient matrix, $K\otimes F1$ indicates a convolution operation of the diffusion matrix and the first setting matrix, and $F1\cdot X$ indicates a dot multiplication of the first setting matrix and the compensation-coefficient matrix.

For example, in the luminance compensating method provided by at least one embodiment of the present disclosure, the obtaining the diffusion matrix of the plurality of backlight units comprises: driving one of the plurality of backlight units to emit light, and causing remaining backlight units not to emit light; and measuring light-emitting luminance values of the display panel.

For example, in the luminance compensating method provided by at least one embodiment of the present disclosure, the adjusting at least one value in the first setting matrix to obtain the second setting matrix comprises: decreasing a maximum value in the first setting matrix by one step size, or increasing a minimum value in the first setting matrix by the one step size.

For example, in the luminance compensating method provided by at least one embodiment of the present disclosure, the compensating for luminance of the display device based on the compensation-coefficient matrix comprises: compensating for light-emitting luminance of the plurality of backlight units based on the compensation-coefficient matrix.

For example, in the luminance compensating method provided by at least one embodiment of the present disclosure, the compensating for light-emitting luminance of the plurality of backlight units based on the compensation-coefficient matrix comprises: multiplying driving currents of the plurality of backlight units by corresponding compensation coefficients in the compensation-coefficient matrix respectively.

For example, in the luminance compensating method provided by at least one embodiment of the present disclosure, the compensating for luminance of the display device based on the compensation-coefficient matrix comprises: compensating for gray level data of the plurality of pixel units based on the compensation-coefficient matrix.

For example, in the luminance compensating method provided by at least one embodiment of the present disclosure, the compensating for gray level data of the plurality of pixel units based on the compensation-coefficient matrix comprises: multiplying gray level data of the plurality of pixel units by corresponding compensation coefficients in the compensation-coefficient matrix respectively based on the plurality of portions.

For example, in the luminance compensating method provided by at least one embodiment of the present disclosure, the compensating for luminance of the display device based on the compensation-coefficient matrix comprises: converting first gray-level data, which is used for displaying an image, of the plurality of pixel units of the display panel into Hue-Saturation-Value-Model data; compensating for lightness data in the Hue-Saturation-Value-Model data based on the compensation-coefficient matrix; and converting the compensated Hue-Saturation-Value-Model data into second gray-level data.

At least one embodiment of the present disclosure further provides a luminance compensating device, comprising a processor and a memory. The memory is configured to store computer instructions adapted to be executed by the processor, and the computer instructions, when executed by the processor, cause the processor to perform the luminance compensating method provided by the embodiments of the present disclosure.

For example, the luminance compensating device provided by at least one embodiment of the present disclosure further comprises an image capturing device. The image capturing device is configured to capture an image of the display panel, and the processor is further configured to process the image captured by the image capturing device to obtain the first luminance matrix.

At least one embodiment of the present disclosure further provides a display device, comprising a backlight module, a display panel and the luminance compensating device provided by the embodiments of the present disclosure.

At least one embodiment of the present disclosure further provides a storage medium. The storage medium is configured to store computer instructions adapted to be executed by a processor, and the computer instructions, when executed by the processor, cause the processor to perform the luminance compensating method provided by the embodiments of the present disclosure.

BRIEF DESCRIPTION OF THE DRAWINGS

In order to clearly illustrate the technical solution of the embodiments of the present disclosure, the drawings of the embodiments will be briefly described in the following. It is obvious that the described drawings are only related to some embodiments of the disclosure and thus are not limitative of the present disclosure.

FIG. 5 is a schematic diagram of a diffusion matrix provided by at least one embodiment of the present disclosure;

FIG. 6 is a schematic diagram of a luminance compensating method provided by at least one embodiment of the present disclosure;

FIG. 7 is a schematic diagram of a luminance compensating method provided by at least one embodiment of the present disclosure;

DETAILED DESCRIPTION

Figure 1:
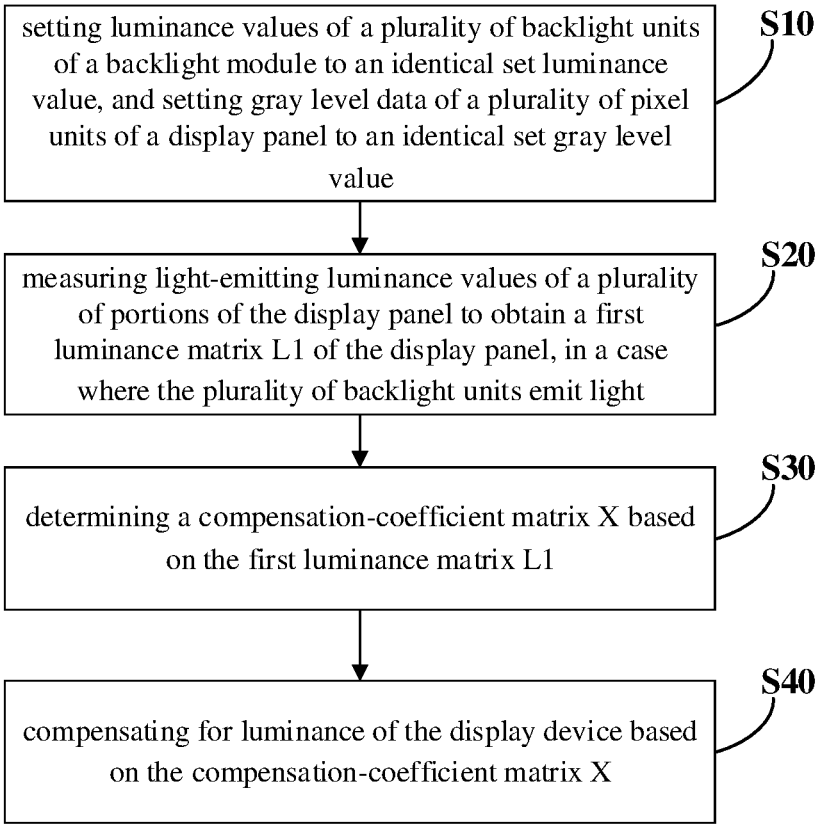
FIG. 1 is a schematic diagram of a luminance compensating method provided by at least one embodiment of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect," "connected," "coupled," etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

A micro-light-emitting diode (micro-LED) array may be used as a backlight module for a liquid crystal display (LCD) device to provide backlight for the LCD device, thereby allowing the LCD device to have higher contrast and a lower power consumption. However, due to limitations in the manufacturing process and the like, the micro-LED array may have a problem of uneven light-emitting luminance when emitting light, and may affect the display effect of the display device in severe cases.

At least one embodiment of the present disclosure provides a luminance compensating method of a display device. The display device comprises a backlight module and a display panel, the display panel comprises a plurality of portions, the backlight module comprises a plurality of backlight units, and the plurality of backlight units respectively correspond to the plurality of portions. The luminance compensating method comprises: setting luminance values of the plurality of backlight units of the backlight module to an identical set luminance value, and setting gray level data of a plurality of pixel units of the display panel to an identical set gray level value; measuring light-emitting luminance values of the plurality of portions of the display panel to obtain a first luminance matrix of the display panel, in a case where the plurality of backlight units emit light; determining a compensation-coefficient matrix based on the first luminance matrix; and compensating for luminance of the display device based on the compensation-coefficient matrix.

At least one embodiment of the present disclosure further provides a luminance compensating device, a display device and a storage medium which are corresponding to the above luminance compensating method.

The luminance compensating method, the luminance compensating device, the display device, and the storage medium provided by the embodiments of the present disclosure may compensate for light-emitting luminance of the backlight module and improve the uniformity of light-emitting luminance of the display panel, thereby improving the display effect of the display device including the display panel.

Hereinafter, the embodiments of the present disclosure will be described in detail with reference to the accompanying drawings.

Figure 2:
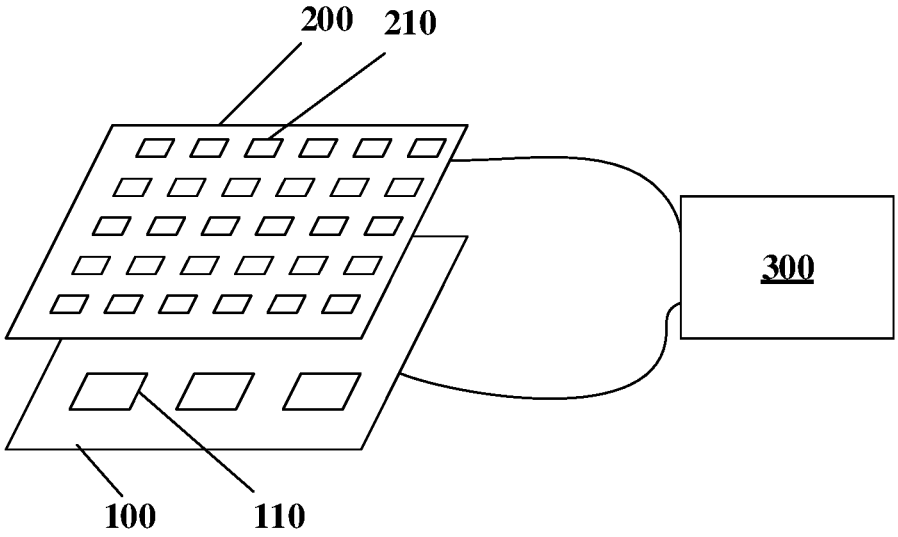
FIG. 2 is a schematic diagram of a display device provided by at least one embodiment of the present disclosure.

At least one embodiment of the present disclosure provides a luminance compensating method of a display device. As illustrated in FIG. 1 and FIG. 2, the luminance compensating method includes the following steps.

Step S10: setting luminance values of a plurality of backlight units 110 of a backlight module 100 to an identical set luminance value, and setting gray level data of a plurality of pixel units 210 of a display panel 200 to an identical set gray level value.

Step S20: measuring light-emitting luminance values of a plurality of portions of the display panel 200 to obtain a first luminance matrix L1 of the display panel 200, in a case where the plurality of backlight units 110 emit light.

Step S30: determining a compensation-coefficient matrix X based on the first luminance matrix L1.

Step S40: compensating for luminance of the display device based on the compensation-coefficient matrix X.

As illustrated in FIG. 2, the display device comprises the backlight module 100 and the display panel 200. For example, the backlight module 100 includes the plurality of backlight units 110, each of the backlight units 110 is provided with, for example, a plurality of micro-LEDs in an array arrangement, and the plurality of micro-LEDs in the backlight module 100 may form a micro-LED array to provide backlight for the display panel 200. For example, the display panel 200 is a liquid crystal display panel, and the display panel 200 includes the plurality of pixel units 210 in an array arrangement. It should be noted that only some of the backlight units 110 and some of the pixel units 210 are schematically illustrated in FIG. 2, and the number of the backlight units 110 and the number of the pixel units 210 may be set based on the size and resolution requirements of the display device, which is not limited in the embodiments of the present disclosure. In addition, for example, the size of the backlight units 110 and the size of the pixel units 210 illustrated in FIG. 2 are merely illustrative and do not represent real scales.

For example, in a case where the display device emits light, the backlight module 100 provides backlight, and at the same time, gray level data is provided for each of the pixel units 210 of the display panel 200 to control the transmittance of each of the pixel units 210, thereby controlling light-emitting luminance of the display panel 200.

In at least one embodiment of the present disclosure, the display panel 200 is divided into a plurality of portions, the backlight module 100 includes the plurality of backlight units 110, and the plurality of backlight units 110 respectively correspond to the plurality of portions. It should be noted that, each of the portions may be identical in size when divided, and for example, each portion may be in a square shape. For example, the display panel 200 is divided into N portions. Accordingly, the backlight module 100 is divided into N portions, and the N portions of the backlight module 100 and the N partitions of the display panel 200 are in one-to-one correspondence. Each portion of display panel 200 may include one or more pixel units 210.

One backlight unit 110 is disposed in each portion of the backlight module 100, and set luminance values (i.e., driving currents) of the plurality of micro-LEDs in one backlight unit 110 are identical. A plurality of pixel units 210 are disposed in each portion of the display panel 200. When the backlight module 100 and the display panel 200 are assembled together, the backlight unit 110 in each portion of the backlight module 100 provides backlight for the plurality of pixel units 210, which corresponds to the portion, of the display panel 200, that is, the luminance of the backlight received by the plurality of pixel units 210 in the same portion of the display panel 200 is identical.

For example, in step S10, the luminance values of the plurality of backlight units 110 of the backlight module 100 are set to an identical set luminance value, and for example, in a case where the luminance values of backlight units 110 are adjusted by pulse width modulation (PWM), set values of PWM are set to an identical value. For example, in an example, the luminance values of the plurality of backlight units 110 may be set to the maximum value, so that the light-emitting luminance of the plurality of backlight units 110 reaches the maximum luminance. Certainly, the embodiments of the present disclosure include but are not limited thereto, and the luminance values of the plurality of backlight units 110 may be set to a value between the minimum value and the maximum value, as long as the luminance values of the plurality of backlight units 110 are set to the same set luminance value.

At the same time, in the step S10, the gray level data of the plurality of pixel units 210 of the display panel 200 is set to an identical set gray level value. For example, taking the display mode of the display panel 200 is a normally black mode as an example, in a case where the display data of the display panel 200 uses 8-bit RGB gray level data, the gray level data of all the pixel units 210 of the display panel 200 may be set to the maximum value 255, that is, the transmittance of all the pixel units 210 of the display panel 200 is maximized Certainly, the embodiments of the present disclosure include but are not limited thereto, and the gray level data of the plurality of pixel units 210 of the display panel 200 may also be set to a value between 0 and 255, such as 199, as long as the gray level data of the plurality of pixel units 210 of the display panel 200 is set to the same set gray level value.

For example, in the step S20, when the plurality of backlight units 110 of the backlight module 100 in FIG. 2 emit light according to the set luminance value in the step S10, light-emitting luminance values of the plurality of portions of the display panel 200 are measured. For example, an image capturing device may be used to capture an image of the display panel 200 on the light-emitting side of the display panel 200, and then the image data captured by the image capturing device is processed to obtain the first luminance matrix L1.

The image data obtained by the image capturing device includes luminance information. When the image data is processed, the luminance information in the image data may be first extracted to form a matrix of light-emitting luminance values of the display panel 200; then the light-emitting luminance values of each portion of the display panel 200 is averaged, that is, the matrix of light-emitting luminance values described above is averaged according to the portions, and the average value of each portion is used as the corresponding light-emitting luminance value of the partition; and finally, the light-emitting luminance values which respectively correspond to the plurality of portions constitute the first luminance matrix L1.

Figures 3, 4:
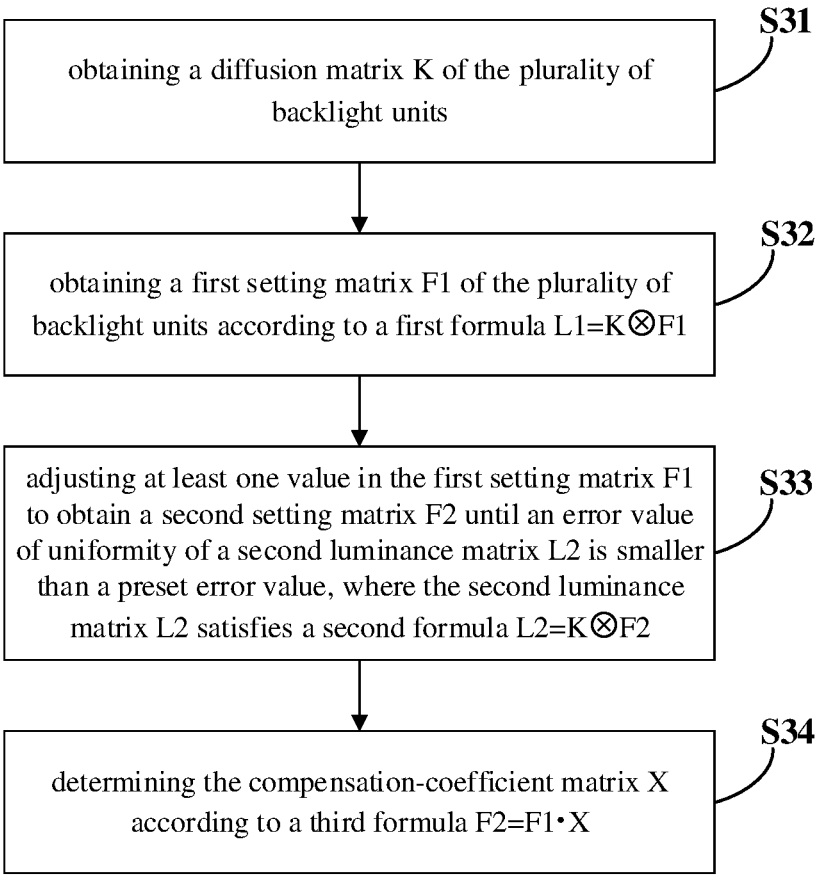
FIG. 3 is a schematic diagram of a first luminance matrix provided by at least one embodiment of the present disclosure.
FIG. 4 is a schematic diagram of a luminance compensating method provided by at least one embodiment of the present disclosure.

When the display panel 200 is divided into Q*M (Q rows by M columns) portions, the first luminance matrix L1 is also a Q*M matrix. For example, as illustrated in FIG. 3, in an example, the display panel 200 may be divided into 7*7 (7 rows by 7 columns) portions, and the obtained first luminance matrix L1 is also a 7*7 matrix in which each of the values (A1, A2, A3, . . . ) represents the light-emitting luminance value of the corresponding portion of the display panel 200. In a case where an error value of uniformity of the display panel 200 is negligible, that is, regardless of the non-uniformity of the display panel 200, the first luminance matrix L1 may be regarded as a matrix of actual light-emitting luminance values of the backlight module 100.

It should be noted that the embodiments of the present disclosure do not limit the type of photosensitive components used in the image capturing device. For example, the photosensitive component in the image capturing device may use a charge-coupled device (CCD), or for example, the photosensitive component in the image capturing device may also use a complementary metal oxide semiconductor (CMOS).

In at least one embodiment of the present disclosure, as illustrated in FIG. 4, the step S30 includes the following steps.

Step S31: obtaining a diffusion matrix K of the plurality of backlight units 110.

Step S32: obtaining a first setting matrix F1 of the plurality of backlight units 110 according to a first formula L1=K⊗F1.

Step S33: adjusting at least one value in the first setting matrix F1 to obtain a second setting matrix F2 until an error value of uniformity of a second luminance matrix L2 is smaller than a preset error value, where the second luminance matrix L2 satisfies a second formula L2=K⊗F2.

Step S34: determining the compensation-coefficient matrix X according to a third formula F2=F1·X.

It should be noted that in the embodiments of the present disclosure, L1 indicates the first luminance matrix, L2 indicates the second luminance matrix, K indicates the diffusion matrix, F1 indicates the first setting matrix, F2 indicates the second setting matrix, X indicates the compensation-coefficient matrix, K⊗F1 indicates a convolution operation of the diffusion matrix K and the first setting matrix F1, and F1·X indicates a dot multiplication of the first setting matrix F1 and the compensation-coefficient matrix X. The same applies to the following embodiments and will not be repeated.

Because when the backlight unit 110 corresponding to each portion emits light, the light emitted will be diffused to adjacent portions while the light is centered on that portion. The greater the distance from the center is, the lower the luminance of the diffused light is. In the embodiments of the present disclosure, as illustrated in FIG. 5, the diffusion matrix K of a backlight unit 110 comprises the measured light-emitting luminance value K0 of the portion corresponding to that backlight unit 110 and the measured light-emitting luminance values (K1, K2 and K3) of adjacent portions. It should be noted that, in the example illustrated in FIG. 5, the diffusion matrix K is illustrated by taking a 3*3 matrix as an example, and the embodiments of the present disclosure include but are not limited thereto. For example, when the diffusion capability of the backlight unit 110 is stronger, the diffusion matrix K may also be a 5*5 matrix, a 7*7 matrix, or a matrix comprising more light-emitting luminance values.

For example, in at least one embodiment of the present disclosure, as illustrated in FIG. 6, the step S31 includes the following steps.

Step S311: driving one backlight unit 110 of the plurality of backlight units 110 to emit light, and causing remaining backlight units 110 not to emit light.

Step S312: measuring light-emitting luminance values of the display panel 200.

For example, in the step S311, one backlight unit 110 of the plurality of backlight units 110 of the backlight module 100 may be driven to emit light, and remaining backlight units 110 do not emit light. For example, the backlight unit 110 located at the center of the backlight module 100 may be driven to emit light.

For example, in the step S312, similar to the step S20, the image capturing device may also be used to capture the image of the display panel 200 on the light-emitting side of the display panel 200, and then the image data captured by the image capturing device is processed to obtain the light-emitting luminance value of the portion corresponding to the backlight unit 110 which emits light and the light-emitting luminance values of adjacent eight portions (the eight portions are around the portion corresponding to the backlight unit 110 which emits light), thereby obtaining the diffusion matrix K as illustrated in FIG. 5. It should be noted that, the detailed description of the method for obtaining the light-emitting luminance values corresponding to the portions in the step S312 may refer to the corresponding description of the step S20, which will not be repeated herein. In addition, in the embodiments of the present disclosure, the diffusion matrices K of the plurality of backlight units 110 may be regarded as the same, so that the diffusion matrix K of one backlight unit 110 may be obtained and the diffusion matrix K may be shared as a public diffusion matrix K by the plurality of backlight units 110.

As described above, for example, in the case where the display panel 200 is divided into 7*7 portions, the first luminance matrix L1 is also a 7*7 matrix (as illustrated in FIG. 3). For example, FIG. 3 may be regarded as the divided 7*7 partitions of the display panel 200 corresponding to the first luminance matrix L1. In obtaining the diffusion matrix K, for example, in the step S311, the backlight unit 110 at the center of the backlight module 100, that is, the backlight unit 110 corresponding to the portion D4, emits light, and the remaining backlight units 110 do not emit light. Then in the step S312, the light-emitting luminance values of all the portions of the display panel 200 may be measured. For example, when the measured light-emitting luminance values of the 8 portions (C3, C4, C5, D3, D5, E3, E4, and E5) of the first ring around the portion D4 are not zero, and the measured light-emitting luminance values of the 16 portions (B2, B3, B4, B5, B6, C6, D6, E6, F6, F5, F4, F3, F2, E2, D2, and C2) of the second ring around the portion D4 are zero or approximately zero, the diffusion matrix K is a 3*3 matrix. For example, when the light-emitting luminance values of the 16 portions (B2, B3, B4, B5, B6, C6, D6, E6, F6, F5, F4, F3, F2, E2, D2, and C2) of the second ring around the portion D4 are not zero, and the light-emitting luminance values of the 24 portions of the third ring, that is, the outermost ring, around the portion D4 are zero or approximately zero, the diffusion matrix K is a 5*5 matrix. And for example, when the light-emitting luminance values of the 24 portions of the third ring, that is, the outermost ring, around the portion D4 are also not zero, the diffusion matrix K is a 7*7 matrix. When the display panel 200 is divided into other numbers of portions, the method for obtaining the diffusion matrix K is similar to the above, and will not be repeated herein.

After obtaining the first luminance matrix L1 and the diffusion matrix K, the step S32 may be performed to obtain the first setting matrix F1 of the plurality of backlight units 110 by a de-convolution operation according to the first formula L1=K⊗F1. For example, in the case where the first luminance matrix L1 is a 7*7 matrix and the diffusion matrix K is a 3*3 matrix, the first setting matrix F1 obtained by the de-convolution operation is also a 7*7 matrix, and each value in the matrix represents an actual set luminance value of each corresponding backlight unit 110 when the light-emitting luminance values of the display panel 200 satisfy the first luminance matrix L1.

It should be noted that, in the embodiments of the present disclosure, the symbol "⊗" represents a convolution operation, and the symbol "·" represents a dot multiplication. The same applies to the following embodiments described herein, and will not be described again.

In the step S33, the second luminance matrix L2 may be obtained by multi-iteration. For example, after the first setting matrix F1 is obtained, at least one value in the first setting matrix F1 may be adjusted to obtain the second setting matrix F2. For example, in an example, the maximum value in the first setting matrix F1 may be decreased by one step size. And for example, in another example, the minimum value in the first setting matrix F1 may be increased by one step size. It should be noted that the step size should be set according to actual conditions, and for example, when the difference between the maximum value and the minimum value in the first setting matrix F1 is 0.5, the step size may be 0.1 or 0.05. In addition, each time when the first setting matrix F1 is adjusted, only one value may be adjusted, or two or more values may be adjusted, which is not limited in the present disclosure.

After adjusting the first setting matrix F1 to obtain the second setting matrix F2, the second luminance matrix L2 is obtained by the convolution operation according to the second formula: L2=K⊗F2, and it is determined whether the error value of uniformity of the second luminance matrix L2 is smaller than the preset error value. If the error value is greater than or equal to the preset error value, the above step of adjusting the first setting matrix F1 is continued until the error value of uniformity of the second luminance matrix L2 is smaller than the preset error value.

In the embodiments of the present disclosure, the error value of uniformity of the second luminance matrix L2 may be obtained as follows. Assume that the maximum value in the second luminance matrix L2 is M1, the minimum value in the second luminance matrix L2 is M2, and the average value of all the values in the second luminance matrix L2 is MA. Then (M1−MA)/MA and (MA−M2)/MA are calculated, and the larger of the two values is used as the error value of uniformity of the second luminance matrix L2. It should be noted that the embodiments of the present disclosure do not limit the manner of calculating the error value of uniformity of the second luminance matrix L2, as long as it is a value that may reflect the uniformity of the second luminance matrix L2. For example, in an example, the preset error value is 5%, and the embodiments of the present disclosure include but are not limited thereto.

After obtaining the first luminance matrix L1 and the second luminance matrix L2, the step S34 may be performed to determine the compensation-coefficient matrix X according to the third formula: F2=F1·X. It should be noted that in the third formula, the relationship between the first luminance matrix F1 and the compensation-coefficient matrix X is a dot multiplication. For example, in the case where the first luminance matrix L1 and the second luminance matrix L2 are both 7*7 matrices, the compensation-coefficient matrix X is also a 7*7 matrix. It is easy to understand that the compensation coefficients in the compensation-coefficient matrix X are the ratios between the elements at the corresponding positions in the second luminance matrix L2 and the first luminance matrix L1, that is, there is a compensation coefficient corresponding to each portion in the display device.

In at least one embodiment of the present disclosure, the step S40 of compensating for luminance of the display device based on the compensation-coefficient matrix X includes the following steps.

Step S41: compensating for light-emitting luminance of the plurality of backlight units 110 based on the compensation-coefficient matrix X.

For example, in an example, the above step S41 includes the following steps.

Step S411: multiplying driving currents of the plurality of backlight units 110 by corresponding compensation coefficients in the compensation-coefficient matrix X respectively.

In the embodiments of the present disclosure, by calculating the compensation-coefficient matrix X and compensating for the driving currents of the plurality of backlight units 110 based on the compensation-coefficient matrix X, the light-emitting luminance of the backlight module 100 may be compensated, and the uniformity of light-emitting luminance of the display panel 200 may be improved, so that the display effect of the display device including the display panel 200 may be improved.

In at least one embodiment of the present disclosure, the step S40 of compensating for luminance of the display device based on the compensation-coefficient matrix X includes the following steps.

Step S42: compensating for gray level data of the plurality of pixel units 210 based on the compensation-coefficient matrix X.

For example, in an example, the above step S42 includes the following steps.

Step S421: multiplying gray level data of the plurality of pixel units 210 by corresponding compensation coefficients in the compensation-coefficient matrix X respectively based on the plurality of portions.

In the step S421, it should be noted that the compensation coefficients multiplied by the gray level data of the pixel units 210 in each of the portions are the same. For example, the gray level data may be RGB gray level data.

In the embodiments of the present disclosure, by calculating the compensation-coefficient matrix X and compensating for gray level data of the plurality of pixel units 210 based on the compensation-coefficient matrix X, the light-emitting luminance of the backlight module 100 may be compensated, and the uniformity of light-emitting luminance of the display panel 200 may be improved, so that the display effect of the display device including the display panel 200 may be improved.

In the luminance compensating method provided by at least one embodiment of the present disclosure, as illustrated in FIG. 7, the step S40 of compensating for luminance of the display device based on the compensation-coefficient matrix X includes the following steps.

Step S50: converting first gray-level data, which is used for displaying an image, of the plurality of pixel units 210 of the display panel 200 into Hue-Saturation-Value-Model data.

Step S60: compensating for lightness data in the Hue-Saturation-Value-Model data based on the compensation-coefficient matrix X.

Step S70: converting the compensated Hue-Saturation-Value-Model data into second gray-level data.

The Hue-Saturation-Value (HSV) Model is a color model which is created based on the visual characteristics of colors. The parameters of the color in the model are: hue (H), saturation (S), and Value (V), and the V indicates the degree of lightness perceived by human eyes.

In the step S50, when the first gray-level data is RGB gray level data, the lightness data V=max (R, G, B), that is, the value of the lightness data V takes the maximum value in the RGB gray level data.

In the step S60, similarly to the step S421, the lightness data in the HSV data corresponding to the plurality of pixel units 210 of the display image is multiplied by corresponding compensation coefficients in the compensation-coefficient matrix X respectively based on the plurality of portions.

Then, in the step S70, the compensated HSV data is reconverted into the second gray-level data. For example, the second gray-level data is provided to the plurality of pixel units 210 of the display panel 200 for driving displaying.

Figure 8:
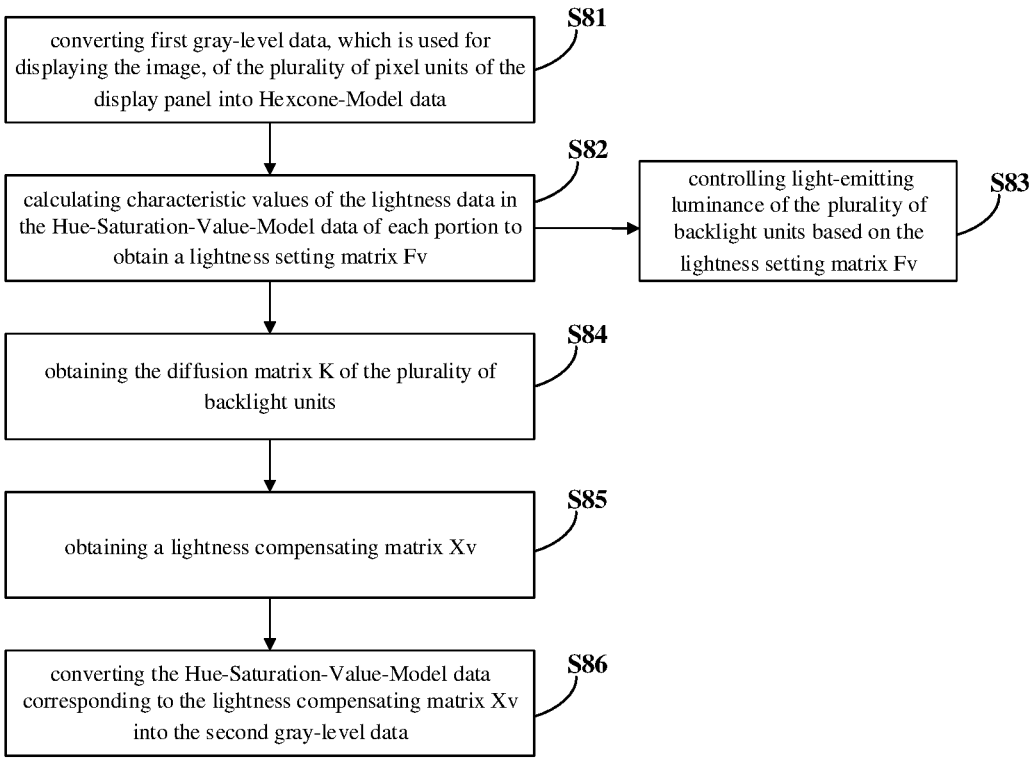
FIG. 8 is a schematic diagram of a dynamic backlight adjusting method based on portions.

For example, FIG. 8 illustrates a local dimming method for a display device, that is, a dynamic backlight adjusting method based on portions, and the method, for example, includes the following steps.

Step S81: converting first gray-level data, which is used for displaying the image, of the plurality of pixel units 210 of the display panel 200 into Hue-Saturation-Value-Model data.

Step S82: calculating characteristic values of the lightness data in the Hue-Saturation-Value-Model data of each portion to obtain a lightness setting matrix Fv.

Step S83: controlling light-emitting luminance of the plurality of backlight units 110 based on the lightness setting matrix Fv.

Step S84: obtaining the diffusion matrix K of the plurality of backlight units 110.

Step S85: obtaining a lightness compensating matrix Xv.

Step S86: converting the Hue-Saturation-Value-Model data corresponding to the lightness compensating matrix Xv into the second gray-level data.

The step S81 is the same as the step S50 in the above embodiments. For example, in the step S81, the lightness data corresponding to the plurality of pixel units 210 of the display panel 200 may constitute a first lightness data matrix Lv1.

In the step S82, for example, in an example, the display panel 200 is divided into 7*7 (7 rows by 7 columns) portions, and the characteristic value for the plurality of lightness data corresponding to each of the portions is calculated and used as the lightness setting values corresponding to the portion. The lightness setting values corresponding to the plurality of portions constitute a lightness setting matrix Fv, and for example, the lightness setting matrix Fv is also a 7*7 matrix. When the characteristic value for the plurality of lightness data of each partition is calculated, for example, a maximum value of the plurality of lightness data may be taken as the characteristic value; for example, the characteristic value may also be calculated based on the cumulative distribution function (CDF) of the plurality of lightness data in each portion; or for example, an average value of the plurality of lightness data or a multiple of the average value may be taken as the characteristic value. The present disclosure does not limit the manner in which the characteristic value of the lightness data is obtained.

After obtaining the lightness setting matrix Fv, the step S83 may be performed to control the light-emitting luminance of the plurality of backlight units 110 based on the lightness setting matrix Fv. For example, in a case where the light-emitting luminance of the backlight units 110 is adjusted by pulse width modulation (PWM), the PWM set value of each backlight unit 110 is adjusted based on the lightness setting matrix Fv.

The above step S84 is the same as the step S31 in the above embodiments, and the details of which will not be repeated herein.

After obtaining the first lightness data matrix Lv1, the lightness setting matrix Fv, and the diffusion matrix K, the step S85 may be performed. In the step S85, the second lightness data matrix Lv2 is first obtained according to a fourth formula: $Lv2=K\otimes Fv$; and then the lightness compensating matrix Xv is obtained according to a fifth formula: $Lv1=Lv2\cdot Xv$. Obtaining the lightness compensating matrix Xv means the compensation of the lightness data in the Hue-Saturation-Value-Model data, which compensates for the influence on the light-emitting luminance of the display panel 200 due to the difference in the light-emitting luminance of the backlight units 110 of the plurality of portions, is completed.

It should be noted that, in the step S85, it is assumed that the first lightness data matrix Lv1 is a 700*700 matrix, the diffusion matrix K is a 3*3 matrix, and the lightness setting matrix Fv is a 7*7 matrix (which relate to the number of rows and the number of columns of portions), and the second lightness data matrix Lv2 calculated by the fourth formula is a 7*7 matrix. When the second lightness data matrix Lv2 is substituted into the fifth formula to obtain the lightness compensating matrix Xv, the second lightness data matrix Lv2 needs to be first extended to a 700*700 matrix based on the division of the portions, and then to be calculated, so that the obtained lightness compensating matrix Xv is also a 700*700 matrix. The dimensions of the matrices in the above embodiments are all exemplary, and the present disclosure has no limitation in this aspect.

In the step S86, the Hue-Saturation-Value-Model data corresponding to the lightness compensating matrix Xv is converted into the second gray-level data. For example, the second gray-level data is provided to the plurality of pixel units 210 of the display panel 200 for driving displaying.

For example, the luminance compensating method illustrated in FIG. 7 may be incorporated into the local dimming method illustrated in FIG. 8. For example, subsequent to the step S85 where the lightness compensating matrix Xv is obtained, the step S60 may be further performed to further compensate for the lightness compensating matrix Xv, and then the step S70 is performed to obtain the second gray-level data for driving displaying.

In the embodiments of the present disclosure, the gray level data of the display image is first converted into the HSV data, then the lightness data in the HSV data is compensated based on the compensation-coefficient matrix X, and finally the compensated HSV data is converted into the gray level data for driving displaying. With this method, the light-emitting luminance of the backlight module 100 may be compensated, and the uniformity of the light-emitting luminance of the display panel 200 may be improved, so that the display effect of the display device including the display panel 200 may be improved.

Figure 9:
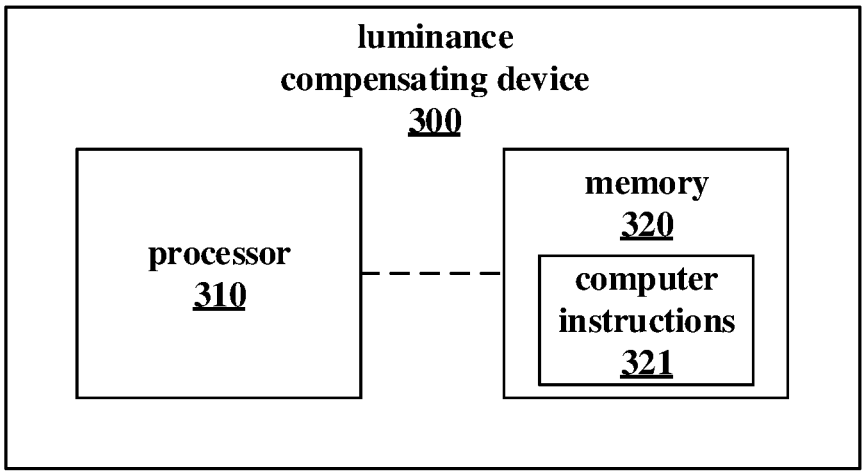
FIG. 9 is a schematic diagram of a luminance compensating device provided by at least one embodiment of the present disclosure.

At least one embodiment of the present disclosure further provides a luminance compensating device 300, and as illustrated in FIG. 9, the luminance compensating device 300 includes a processor 310 and a memory 320. The memory 320 is configured to store computer instructions 321 adapted to be executed by the processor 310, and the computer instructions 321, when executed by the processor 310, cause the processor 310 to perform the steps in the luminance compensating method provided by the embodiments of the present disclosure.

Figure 10:
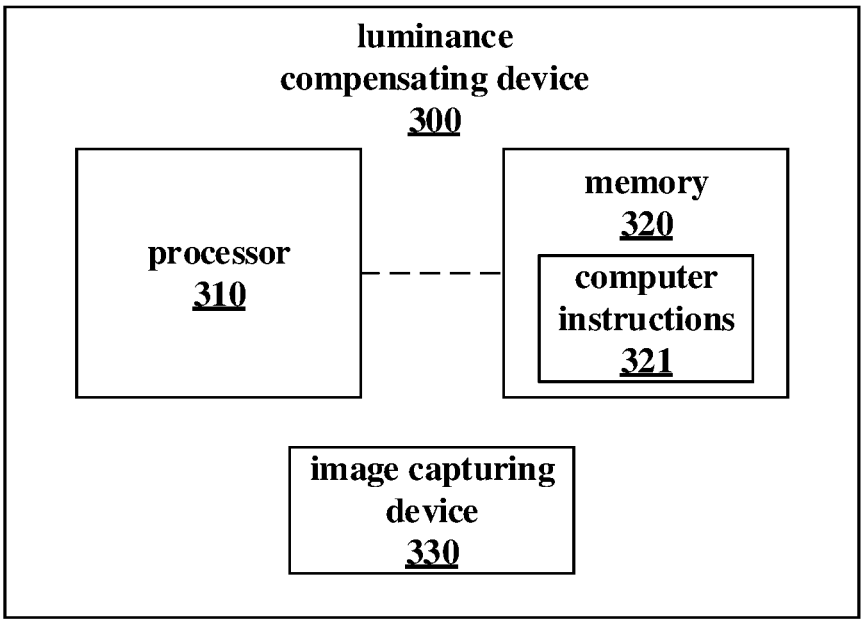
FIG. 10 is a schematic diagram of another luminance compensating device provided by at least one embodiment of the present disclosure.

For example, in the luminance compensating device 300 provided by at least one embodiment of the present disclosure, as illustrated in FIG. 10, an image capturing device 330 may also be included. For example, the image capturing device 330 is configured to capture an image of the display panel 200, and the processor 310 is further configured to process the image captured by the image capturing device 330 to obtain the first luminance matrix L1. It should be noted that the detailed description of obtaining the first luminance matrix L1 may refer to the corresponding description in the above embodiments, and the details of which will not be repeated herein.

The luminance compensating device 300 provided by the embodiments of the present disclosure may compensate for light-emitting luminance of the backlight module 100 and improve the uniformity of the light-emitting luminance of the display panel 200, so that the display effect of the display device including the display panel 200 may be improved.

Figure 11:
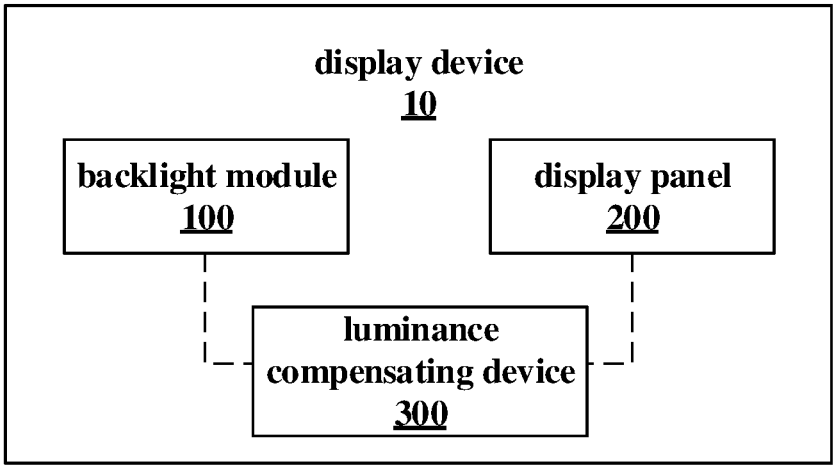
FIG. 11 is a schematic diagram of a display device provided by at least one embodiment of the present disclosure.

At least one embodiment of the present disclosure further provides a display device 10, and as illustrated in FIG. 2 and FIG. 11, the display device 10 includes a backlight module 100, a display panel 200, and a luminance compensating device 300 provided by the embodiments of the present disclosure. For example, the luminance compensating device 300 is electrically connected to the backlight module 100 and the display panel 200, respectively, so that the luminance of the backlight module 100 or the luminance of the display panel 200 may be compensated based on the compensation-coefficient matrix X. The detailed description of the backlight module 100, the display panel 200, and the luminance compensating device 300 may refer to the above embodiments, and the details of which will not repeated herein.

The display device 10 provided by the embodiments of the present disclosure may compensate for light-emitting luminance of the backlight module 100 and improve the uniformity of the light-emitting luminance of the display panel 200, so that the display effect of the display device 10 including the display panel 200 may be improved.

Figure 12:
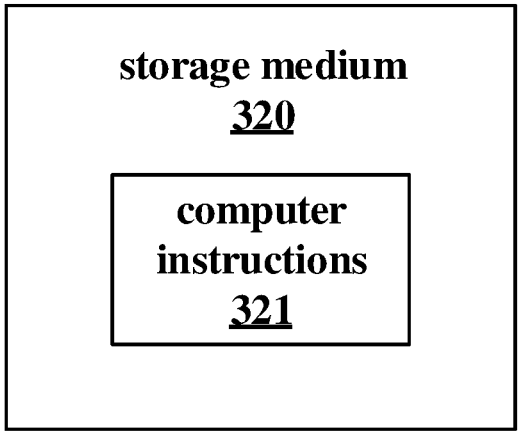
FIG. 12 is a schematic diagram of a storage medium provided by at least one embodiment of the present disclosure.

At least one embodiment of the present disclosure further provides a storage medium 320. As illustrated in FIG. 12, the storage medium 320 is configured to store computer instructions 321 adapted to be executed by a processor, and the computer instructions 321, when executed by the processor, cause the processor to perform the steps in the luminance compensating method provided by the embodiments of the present disclosure.

For example, in an example, the storage medium 320 may be disposed in a computing device. The computing device may further include a processor, and the processor may execute the computer instructions 321 stored in the storage medium 320.

In the embodiments of the present disclosure, the processor may be implemented by a universal integrated circuit chip or an application specific integrated circuit chip. For example, the integrated circuit chip may be disposed on a mainboard, and for example, a storage medium, a power supply circuit and the like may be disposed on the mainboard. In addition, the processor may also be implemented by circuit or by software, hardware (circuit), firmware, or any combination thereof. In the embodiments of the present disclosure, the processor may include various computing structures, such as a complex instruction set computer (CISC) structure, a reduced instruction set computer (RISC) structure, or a structure that implements a combination of multiple instruction sets. In some embodiments, the processor may also be a central processing unit, a microprocessor unit, such as an X86 processor, an ARM processor, or the processor may be a graphics processing unit (GPU) or a tensor processing unit (TPU), or may be a digital signal processing (DSP) unit, etc.

In the embodiments of the present disclosure, the storage medium may be disposed, for example, on the mainboard described above. The storage medium may store instructions and/or data adapted to be executed by the processor, and store data generated by running instructions, etc., and the generated data may be structured data or unstructured data, etc. For example, the storage medium may include one or more computer program products. The computer program products may include various forms of computer readable memory, e.g., volatile memories and/or nonvolatile memories. The volatile memory, for instance, may include a random access memory (RAM) and/or a cache. The nonvolatile memory, for instance, may include a read-only memory (ROM), a magnetic disk, a optical disk, a semiconductor memory (such as a flash memory, a resistive random access memory, etc.), and the like. One or more computer program instructions may be stored on the computer readable memory, and the processor may execute the program instructions, so as to implement the desired functions in the embodiments of the present disclosure (implemented by the processor).

What have been described above are only specific implementations of the present disclosure, the protection scope of the present disclosure is not limited thereto, and the protection scope of the present disclosure should be based on the protection scope of the claims.

What is claimed is:

1. A luminance compensating method of a display device, wherein the display device comprises a backlight module and a display panel, the display panel comprises a plurality of portions, the backlight module comprises a plurality of backlight units, and the plurality of backlight units respectively correspond to the plurality of portions, and the luminance compensating method comprises:

setting luminance values of the plurality of backlight units of the backlight module to an identical set luminance value, and setting gray level data of a plurality of pixel units of the display panel to an identical set gray level value;

measuring light-emitting luminance values of the plurality of portions of the display panel to obtain a first luminance matrix of the display panel, in a case where the plurality of backlight units emit light;

determining a compensation-coefficient matrix based on the first luminance matrix; and compensating for luminance of the display device based on the compensation-coefficient matrix, the determining the compensation-coefficient matrix based on the first luminance matrix comprises:

obtaining a diffusion matrix of the plurality of backlight units;

obtaining a first setting matrix of the plurality of backlight units according to a first formula $L1=K\otimes F1$;

adjusting at least one value in the first setting matrix to obtain a second setting matrix until an error value of uniformity of a second luminance matrix is smaller than a preset error value, wherein the second luminance matrix satisfies a second formula $L2=K\otimes F2$; and determining the compensation-coefficient matrix according to a third formula $F2=F1\cdot X$, wherein L1 indicates the first luminance matrix, L2 indicates the second luminance matrix, K indicates the diffusion matrix, F1 indicates the first setting matrix, F2 indicates the second setting matrix, X indicates the compensation-coefficient matrix, K⊗F1 indicates a convolution operation of the diffusion matrix and the first setting matrix, and F1·X indicates a dot multiplication of the first setting matrix and the compensation-coefficient matrix.

2. The luminance compensating method according to claim 1, wherein the obtaining the diffusion matrix of the plurality of backlight units comprises:

driving one of the plurality of backlight units to emit light, and causing remaining backlight units not to emit light; and measuring light-emitting luminance values of the display panel.

3. The luminance compensating method according to claim 1, wherein the adjusting at least one value in the first setting matrix to obtain the second setting matrix comprises:

decreasing a maximum value in the first setting matrix by one step size, or increasing a minimum value in the first setting matrix by the one step size.

4. The luminance compensating method according to claim 1, wherein the compensating for luminance of the display device based on the compensation-coefficient matrix comprises:

compensating for light-emitting luminance of the plurality of backlight units based on the compensation-coefficient matrix.

5. The luminance compensating method according to claim 4, wherein the compensating for light-emitting luminance of the plurality of backlight units based on the compensation-coefficient matrix comprises:

multiplying driving currents of the plurality of backlight units by corresponding compensation coefficients in the compensation-coefficient matrix respectively.

6. The luminance compensating method according to claim 1, wherein the compensating for luminance of the display device based on the compensation-coefficient matrix comprises:

compensating for gray level data of the plurality of pixel units based on the compensation-coefficient matrix.

7. The luminance compensating method according to claim 6, wherein the compensating for gray level data of the plurality of pixel units based on the compensation-coefficient matrix comprises:

multiplying gray level data of the plurality of pixel units by corresponding compensation coefficients in the compensation-coefficient matrix respectively based on the plurality of portions.

8. The luminance compensating method according to claim 1, wherein the compensating for luminance of the display device based on the compensation-coefficient matrix comprises:

converting first gray-level data, which is used for displaying an image, of the plurality of pixel units of the display panel into Hue-Saturation-Value-Model data;

compensating for lightness data in the Hue-Saturation-Value-Model data based on the compensation-coefficient matrix; and converting the compensated Hue-Saturation-Value-Model data into second gray-level data.

9. A luminance compensating device, comprising a processor and a memory, wherein the memory is configured to store computer instructions adapted to be executed by the processor, and the computer instructions, when executed by the processor, cause the processor to perform:

setting luminance values of a plurality of backlight units of a backlight module of a display device to an identical set luminance value, and setting gray level data of a plurality of pixel units of a display panel of the display device to an identical set gray level value;

measuring light-emitting luminance values of a plurality of portions of the display panel to obtain a first luminance matrix of the display panel, in a case where the plurality of backlight units emit light;

determining a compensation-coefficient matrix based on the first luminance matrix; and compensating for luminance of the display device based on the compensation-coefficient matrix, the determining the compensation-coefficient matrix based on the first luminance matrix comprises:

obtaining a diffusion matrix of the plurality of backlight units;

obtaining a first setting matrix of the plurality of backlight units according to a first formula L1=K⊗F1;

adjusting at least one value in the first setting matrix to obtain a second setting matrix until an error value of uniformity of a second luminance matrix is smaller than a preset error value, wherein the second luminance matrix satisfies a second formula L2=K⊗F2; and determining the compensation-coefficient matrix according to a third formula F2=F1·X, wherein L1 indicates the first luminance matrix, L2 indicates the second luminance matrix, K indicates the diffusion matrix, F1 indicates the first setting matrix, F2 indicates the second setting matrix, X indicates the compensation-coefficient matrix, K⊗F1 indicates a convolution operation of the diffusion matrix and the first setting matrix, and F1·X indicates a dot multiplication of the first setting matrix and the compensation-coefficient matrix.

10. The luminance compensating device according to claim 9, wherein the obtaining the diffusion matrix of the plurality of backlight units comprises:

driving one of the plurality of backlight units to emit light, and causing remaining backlight units not to emit light; and measuring light-emitting luminance values of the display panel.

11. The luminance compensating device according to claim 9, wherein the adjusting at least one value in the first setting matrix to obtain the second setting matrix comprises:

decreasing a maximum value in the first setting matrix by one step size, or increasing a minimum value in the first setting matrix by the one step size.

12. The luminance compensating device according to claim 9, wherein the compensating for luminance of the display device based on the compensation-coefficient matrix comprises:

compensating for light-emitting luminance of the plurality of backlight units based on the compensation-coefficient matrix.

13. The luminance compensating device according to claim 12, wherein the compensating for light-emitting luminance of the plurality of backlight units based on the compensation-coefficient matrix comprises:

multiplying driving currents of the plurality of backlight units by corresponding compensation coefficients in the compensation-coefficient matrix respectively.

14. The luminance compensating device according to claim 9, wherein the compensating for luminance of the display device based on the compensation-coefficient matrix comprises:

compensating for gray level data of the plurality of pixel units based on the compensation-coefficient matrix.

15. The luminance compensating device according to claim 14, wherein the compensating for gray level data of the plurality of pixel units based on the compensation-coefficient matrix comprises:

multiplying gray level data of the plurality of pixel units by corresponding compensation coefficients in the compensation-coefficient matrix respectively based on the plurality of portions.

16. The luminance compensating device according to claim 9, further comprising an image capturing device, wherein the image capturing device is configured to capture an image of the display panel, and the processor is further configured to process the image captured by the image capturing device to obtain the first luminance matrix.

17. A non-transitory storage medium, wherein the storage medium is configured to store computer instructions adapted to be executed by a processor, and the computer instructions, when executed by the processor, cause the processor to perform:

setting luminance values of a plurality of backlight units of a backlight module of a display device to an identical set luminance value, and setting gray level data of a plurality of pixel units of a display panel of the display device to an identical set gray level value;

measuring light-emitting luminance values of a plurality of portions of the display panel to obtain a first luminance matrix of the display panel, in a case where the plurality of backlight units emit light;

determining a compensation-coefficient matrix based on the first luminance matrix; and compensating for luminance of the display device based on the compensation-coefficient matrix, the determining the compensation-coefficient matrix based on the first luminance matrix comprises:

obtaining a diffusion matrix of the plurality of backlight units;

obtaining a first setting matrix of the plurality of backlight units according to a first formula $L\mathbf{1}=K\otimes F\mathbf{1}$;

adjusting at least one value in the first setting matrix to obtain a second setting matrix until an error value of uniformity of a second luminance matrix is smaller than a preset error value, wherein the second luminance matrix satisfies a second formula $L\mathbf{2}=K\otimes F\mathbf{2}$; and determining the compensation-coefficient matrix according to a third formula $F\mathbf{2}=F\mathbf{1}\cdot X$, where $L\mathbf{1}$ indicates the first luminance matrix, $L\mathbf{2}$ indicates the second luminance matrix, K indicates the diffusion matrix, $F\mathbf{1}$ indicates the first setting matrix, $F\mathbf{2}$ indicates the second setting matrix, X indicates the compensation-coefficient matrix, $K\otimes F\mathbf{1}$ indicates a convolution operation of the diffusion matrix and the first setting matrix, and $F\mathbf{1}\cdot X$ indicates a dot multiplication of the first setting matrix and the compensation-coefficient matrix.

* * * * *